US011795647B2

(12) United States Patent
Oltmann

(10) Patent No.: US 11,795,647 B2
(45) Date of Patent: Oct. 24, 2023

(54) INSTALLATION ARRANGEMENT WITH JACK-UP RIG AND A BARGE AND A METHOD FOR SETTING UP THE INSTALLATION ARRANGEMENT

(71) Applicant: TRACTEBEL OVERDICK GMBH, Hamburg (DE)

(72) Inventor: Klaas Oltmann, Seevetal (DE)

(73) Assignee: Tractebel Overdick GmbH, Hamburg (DE)

( * ) Notice: Subject to any disclaimer, the term of this patent is extended or adjusted under 35 U.S.C. 154(b) by 44 days.

(21) Appl. No.: 17/621,972

(22) PCT Filed: Jun. 9, 2020

(86) PCT No.: PCT/EP2020/065982
§ 371 (c)(1),
(2) Date: Dec. 22, 2021

(87) PCT Pub. No.: WO2020/260011
PCT Pub. Date: Dec. 30, 2020

(65) Prior Publication Data

US 2022/0243415 A1 Aug. 4, 2022

(30) Foreign Application Priority Data

Jun. 26, 2019 (DE) ..... 10 2019 117 268.3

(51) Int. Cl.
*E02B 17/02* (2006.01)
*B63C 7/06* (2006.01)
(Continued)

(52) U.S. Cl.
CPC ..... *E02B 17/021* (2013.01); *B63C 7/06* (2013.01); *B66C 23/18* (2013.01); *E02B 2017/006* (2013.01); *E02B 2017/0047* (2013.01)

(58) Field of Classification Search
CPC ..... E02B 17/021; E02B 2017/0047; E02B 2017/006; B63C 7/06; B66C 23/18
See application file for complete search history.

(56) References Cited

U.S. PATENT DOCUMENTS

| | | | | |
|---|---|---|---|---|
| 3,537,413 | A | 11/1970 | Farrell | |
| 10,569,977 | B1 * | 2/2020 | Hammer | B63B 27/10 |
| 11,168,666 | B1 * | 11/2021 | van Loon | F03D 13/10 |

FOREIGN PATENT DOCUMENTS

| | | | |
|---|---|---|---|
| DE | 102011118712.3 | A1 | 5/2012 |
| GB | 2555414 | A | 5/2018 |
| WO | 2019081440 | A1 | 5/2019 |

OTHER PUBLICATIONS

International Search Report, European Patent Office, dated Sep. 9, 2020.

* cited by examiner

*Primary Examiner* — Janine M Kreck
(74) *Attorney, Agent, or Firm* — Bay State IP, LLC

(57) ABSTRACT

An installation arrangement with a barge and a jack-up rig which floats in a first position on the sea and has a hull which is slotted vertically from the surface of the sea and has a slot width which is greater than that of the barge so that the barge can move into a slot, wherein the jack-up rig has supporting legs which can move to and from along a height relative to the hull and can be set down on the seabed. The hull and the barge can be lifted along the support legs. The slot extends along the entire longitudinal extent of the barge over the entire height of the hull, and securing means are arranged on the barge and on the slot and said securing means interact and secure the barge in the raised position in a fixed position on the jack-up rig.

11 Claims, 7 Drawing Sheets

Figure 1:
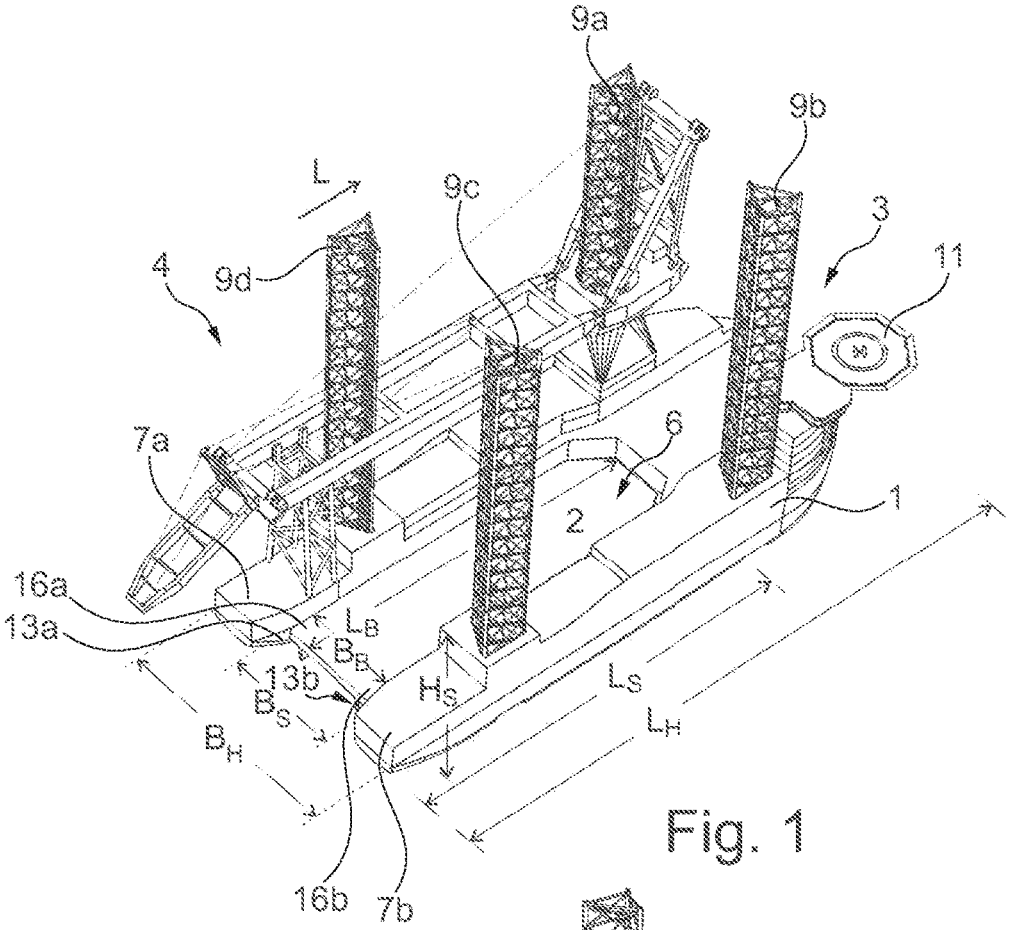

(51) Int. Cl.
*B66C 23/18* (2006.01)
*E02B 17/00* (2006.01)

INSTALLATION ARRANGEMENT WITH JACK-UP RIG AND A BARGE AND A METHOD FOR SETTING UP THE INSTALLATION ARRANGEMENT

CROSS REFERENCE TO RELATED APPLICATION

This application is for entry into the U.S. National Phase from which priority is claimed under all applicable sections of Title 35 of the United States Code including, but not limited to, Sections 120, 363, and 365(c) to International Application No. PCT/EP2020/065982 filed on Jun. 09, 2020, and which in turn claims priority under 35 USC 119 to German Patent Application No. 102019117268.3 filed on Jun. 26, 2019.

The invention relates to an installation arrangement according to the preamble of claim 1. The invention also relates to a method for setting up an installation arrangement with a jack-up rig and a barge.

Installation arrangements are known in the prior art.

A watercraft consisting of a barge and a dock vessel is known from DE 10 2011 118 712 A1. The dock vessel surrounds the barge completely at the bottom and enables the barge to be lifted out of the water on four supporting legs by means of jacking systems.

U.S. Pat. No. 3,537,413 discloses a slotted vessel to accommodate a plurality of barges which can be brought to the same height along the well of the vessel by means of jacking systems, so that the barges which are towed individually in inland waters can be made seaworthy for the open sea as a compact unit.

EP 3 170 732 A1 discloses a floatable lifting pontoon to receive a cargo to be transported. The lifting pontoon has two side walls which are connected to one another via a loading deck. The lifting pontoon can be lifted out of the water on four supporting legs.

A vessel which has a deck and lateral ballast tanks and is intended for transporting loads between the sea and a quay is known from GB 2555414 A.

GB 2567218 A discloses a floatable and lowerable vessel which can be used for fitting jackets for wind turbines or the like.

A self-propelled offshore installation vessel with a jack-up rig which has a continuous main loading deck is known from WO 2019 081 440 A1. Along the height in the stern region the jack-up rig has a non-continuous opening, the base of which is designed as a main loading deck. Components which are to be installed can be loaded onto the main loading deck. In principle, therefore, the main loading deck is dry during the transport. It is also conceivable that the jack-up rig is temporarily lowered, the main loading deck is flooded and a barge floats above the main loading deck. The main loading deck is then drained as the jack-up rig is raised by a ballasting system so that the barge rests on the main loading deck.

A disadvantage of the described installation arrangement is the fact that the jack-up rig requires a complex ballasting system in order to be able to be loaded with a barge. Furthermore, the draining of the main loading deck of the jack-up rig is problematic.

Therefore in a first aspect it is an object of the present invention to provide an installation arrangement referred to in the introduction which avoids the above-mentioned disadvantages.

In a second aspect it is an object of the present invention to provide a method for setting up an installation platform which avoids the above-mentioned disadvantages.

In a first aspect this object is achieved by an installation arrangement referred to in the introduction and having the features of claim 1.

The installation arrangement comprises two main components: a barge on the one hand and a jack-up rig on the other hand. The concept of the barge should be understood in a broad sense here; it may a vessel which is or is not self-propelled, and which preferably has a main loading deck on which components for wind turbines, transformer stations, drilling rigs, etc. can be transported.

The jack-up rig is designed to be self-floating. It can be self-propelled, i.e. it can have a drive which allows it to bring the jack-up rig from the port to the location without an additional tug. The jack-up rig can have a crane, preferably a slewing crane, by which the components can be unloaded from the barge and built up directly on the seabed or on parts which are already constructed.

The jack-up rig has a hull which is slotted vertically relative to the surface of the sea; here too the concept of the slot should be understood in a broad sense. The slot can have a width which is half, 60%, 70% or even more of the width of the jack-up rig as a whole along the respective cross-section, and the slot can have a length which extends over half, 60%, 70% or even 80% of the length of the jack-up rig. In the section including the slot the jack-up rig is preferably U-shaped in a view from above.

A width of the slot is greater than a width of the barge. A width of the slot in each cross-section in the longitudinal direction is preferably greater than an associated width of the barge. In this case "the associated width of the barge" means the width of the point on the barge which, with a barge moved completely into the slot, is arranged in the same cross-section.

The slot is designed so that the barge can move into the slot or can also move out again.

The jack-up rig has movable supporting legs. This can involve at least three supporting legs, preferably four; however, five, six or any higher number of supporting legs are also conceivable. The supporting legs are movable to and fro along a height relative to the hull of the jack-up rig. They are individually movable or movable in a group. The supporting legs are preferably perpendicular to the surface of the sea when the jack-up rig is floating in the sea. Each of the supporting legs has a lifting mechanism. The lifting mechanism makes it possible to lift the hull of the jack-up rig, together with the barge moved into the slot, out of the sea, so that in a raised position of the jack-up rig both the hull of the jack-up rig and also the barge are no longer in contact with the surface of the sea.

According to the invention the slot extends along the entire longitudinal extent of the moved-in barge over the entire height of the hull, in other words the jack-up rig has no main loading deck running below the barge. The region of the barge towards the seabed is open, because the slot extends over the entire height of the jack-up rig. According to the invention securing means are arranged on the barge and the slot, and said securing means interact and secure the barge in the raised position in a positionally fixed fashion on the jack-up rig. The securing means can be designed in a different manner.

The embodiment of the jack-up rig according to the invention makes it possible, on the one hand, that a barge can move into the slot without ballasting of the jack-up rig and, on the other hand, when the jack-up rig is being raised an immediate and fast draining of the slot is possible, since the jack-up rig has no main loading deck between the branches of the slot which are preferably parallel to one another.

The securing means can be formed for example by brackets which run along the two opposing inner sides of the branches of the slot. The brackets can be continuous or interrupted. The brackets can be formed inside on the inner walls of the slot, but also at the same time as an inner extension of the underside of the hull towards the seabed. In the first case the barge can have corresponding lateral projections, in the second case the barge has such a width on the side towards the seabed that it can move over the brackets and the width is greater than the clear distance between the end faces of the brackets.

However, other securing means, for example locking devices or the like, are also conceivable.

However, brackets have the advantage that a further fastening step is not necessary. The barge can simply move by itself or can be drawn into the slot by corresponding ropes or pulling devices, and due to the lifting of the jack-up rig the barge rests by itself on the brackets and is therefore secured on the jack-up rig in the raised location in a positionally fixed manner. The slot can extend over at least 30%, preferably at least 50%, particularly preferably at least 90% of the longitudinal extent of the hull.

In order that the jack-up rig can stand in a stable manner on the seabed, at least one supporting leg is advantageously arranged on the bow side of the slot, also two or more supporting legs can be arranged on the bow side of the slot and simultaneously two or more supporting legs can be provided in the stern end section of the jack-up rig, that is to say in the region of the slot in the jack-up rig, and preferably one supporting leg can be provided on each branch of the slot.

The jack-up rig advantageously has a slewing crane which makes it possible to lift components arranged on the barge, to pivot them sideways and set them down at the desired location, in order for example to construct a wind turbine, a transformer station or a drilling rig offshore or in order to replace heavy components such as for example transformers offshore.

In a second aspect, the object of the invention is achieved by a method with the features of claim 8. The method is particularly suitable for setting up an installation arrangement in accordance with one of the above-mentioned installation arrangements. Conversely, each of the above-mentioned installation arrangements can be set up by one of the methods described below.

The installation arrangement comprises a jack-up rig and a barge. The jack-up rig is brought to the location. The jack-up rig has a hull which is slotted vertically relative to the surface of the sea with a slot having a slot width which is greater than a width of the barge, wherein the slot extends along the entire longitudinal extent of the moved-in barge over the entire height of the hull. The jack-up rig is self-floating.

After the jack-up rig is brought to the location the supporting legs are lowered until they are placed on the seabed. However, this step can also be carried out later.

The barge is moved into the slot in the jack-up rig, and the supporting legs can be lowered beforehand or afterwards. The securing means on the barge and on the slot interact, and the jack-up rig is lifted out of the water with the barge. For lifting, a conventional jacking system is used which is arranged on the supporting legs of the jack-up rig.

The method according to the invention makes it possible to move the jack-up rig to the location and to dispense with ballasting the jack-up rig at the location. The jack-up rig does not need to be lowered further into the sea. The barge can be moved into the jack-up rig which has been brought to the location; repeated ballasting is likewise not necessary, but the jack-up rig with the moved-in barge can be lifted out of the sea immediately by means of the lifting system of the supporting legs.

As the barge moves into the slot it continuously has a clear distance from the seabed over the entire longitudinal extent of the underwater surface of the barge. Therefore the barge does not move over a floor or a deck, in particular a main loading deck, of the jack-up rig, but moves into a slot which is in the form of an opening which is largely completely open towards the seabed, so that the barge with its entire underwater surface has a clear distance from the seabed.

Figure 2:
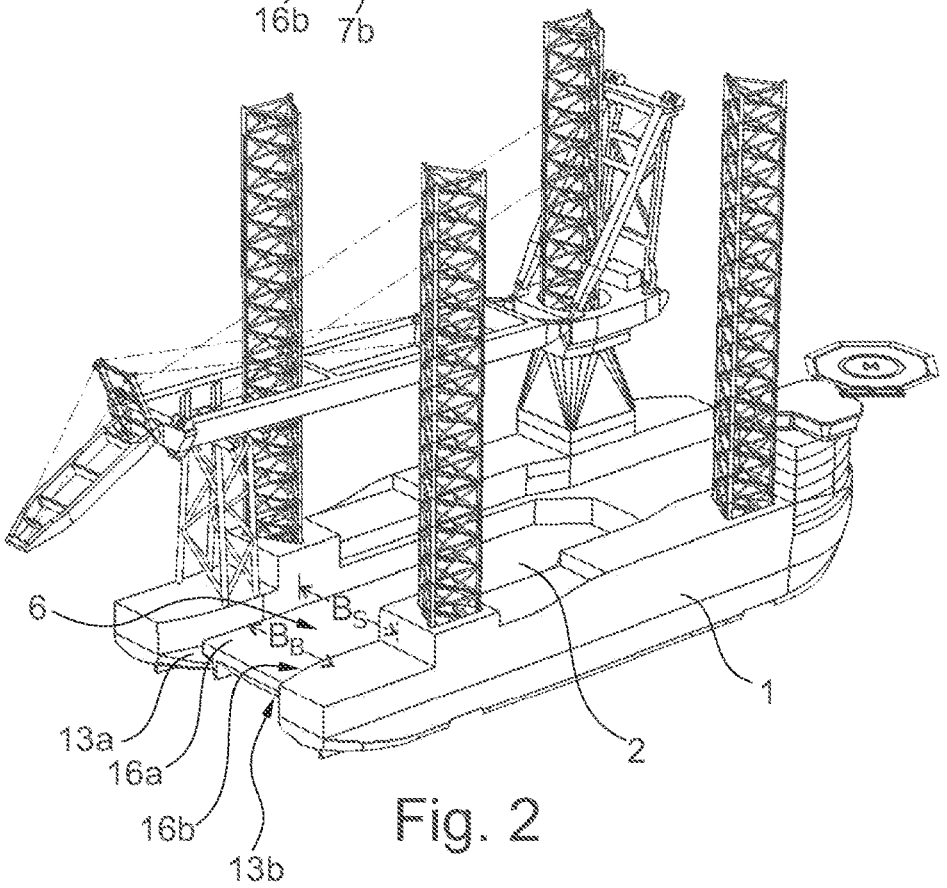
Figure 3:
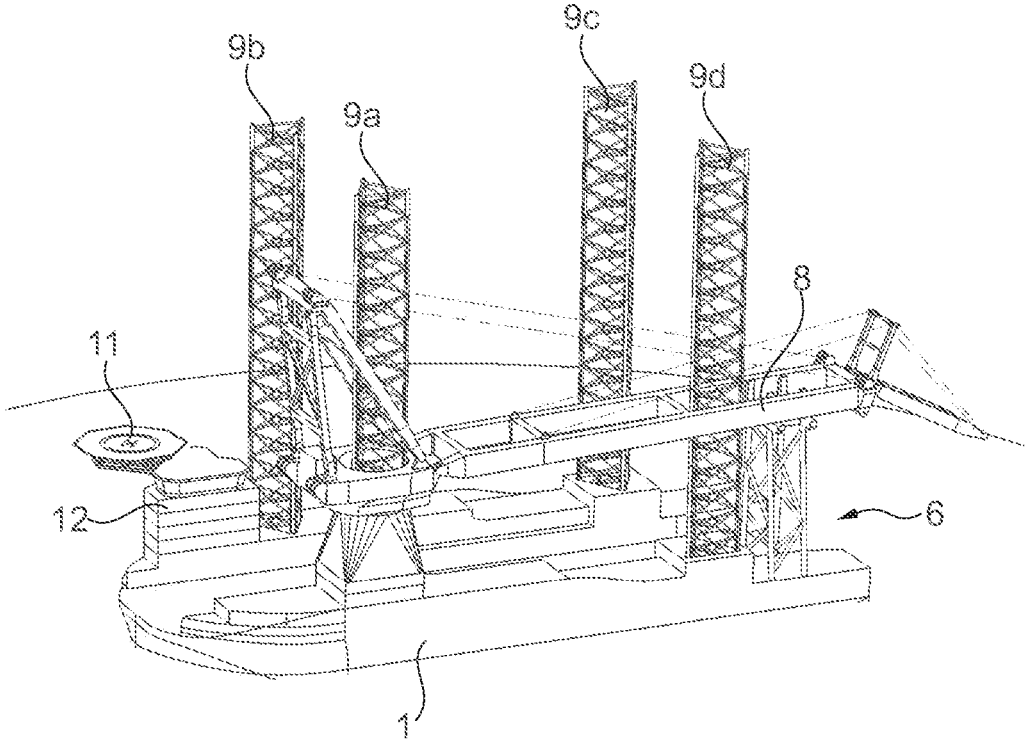
Figure 4:
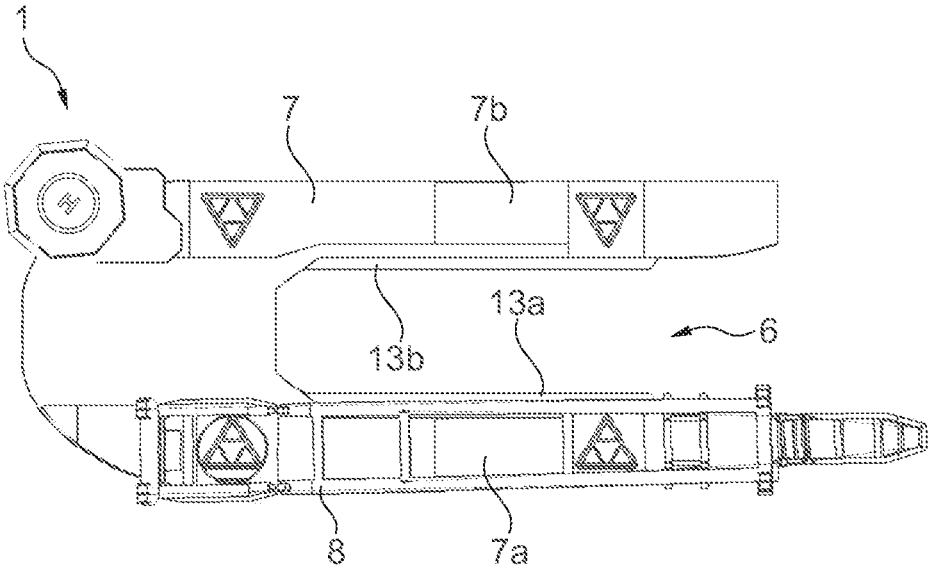
Figure 5:
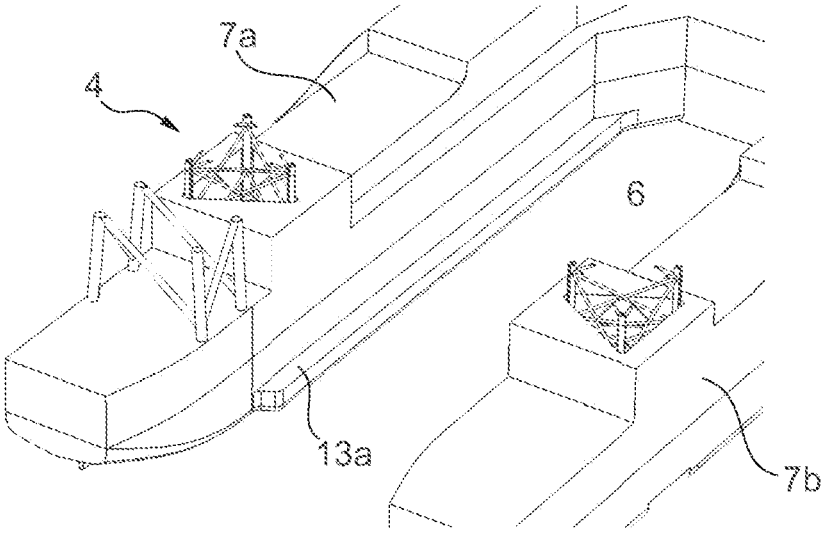
Figure 6:
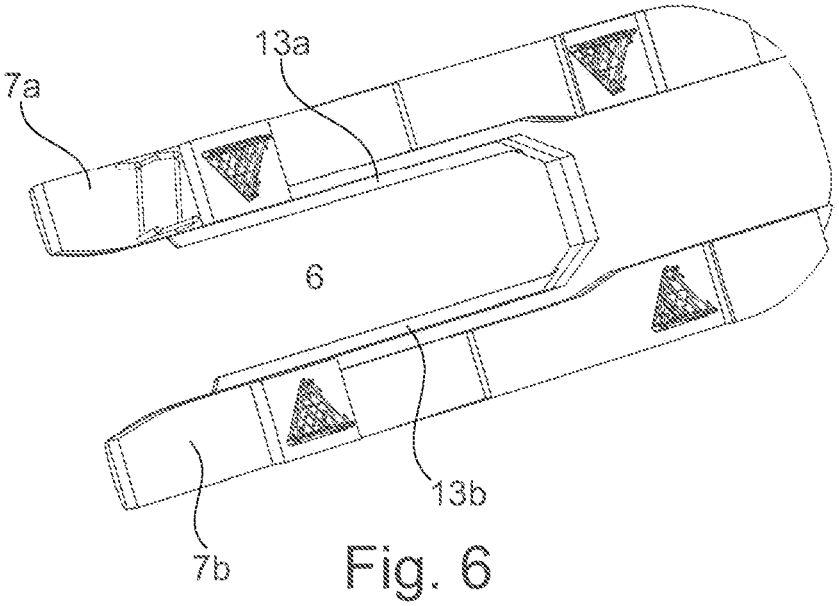
Figure 7:
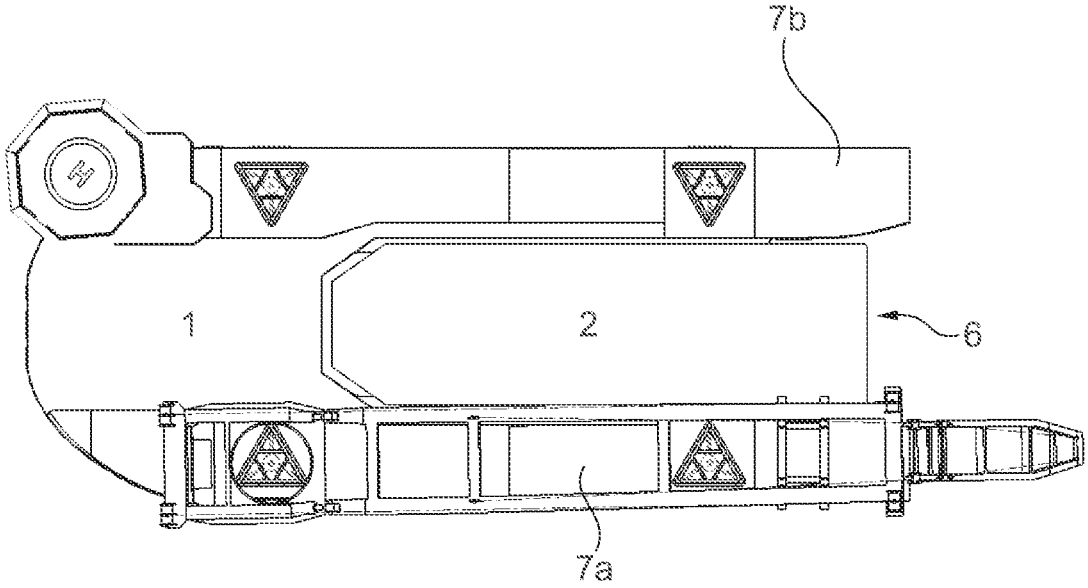
Figure 8:
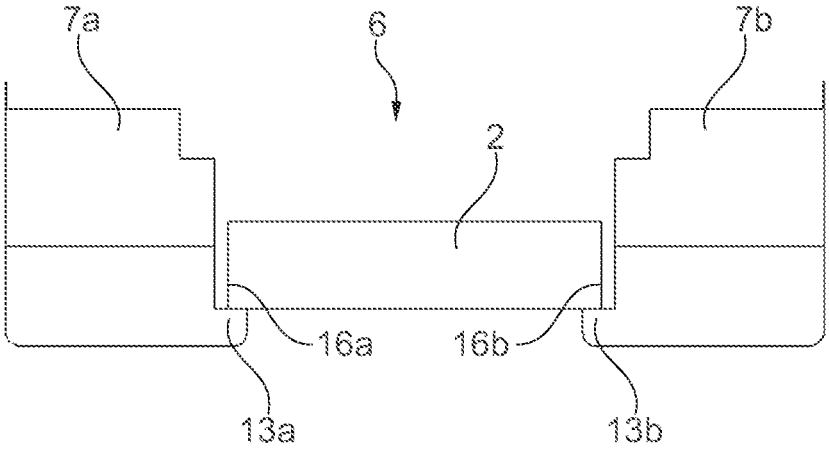

The invention is described with reference to embodiments in thirteen figures, in which:

FIG. 1 shows an installation arrangement according to the invention in a first perspective view, FIG. 2 shows the installation arrangement according to the invention in a second perspective view, FIG. 3 shows the installation arrangement in a third perspective view, FIG. 4 shows the installation arrangement according to FIG. 1 in a plan view without a barge, FIG. 5 shows a jack-up rig of the installation arrangement in a perspective view at the stern end, FIG. 6 shows a perspective plan view of the jack-up rig without a barge, FIG. 7 shows a plan view of the jack-up rig with a barge, FIG. 8 shows a sectional view of the installation arrangement perpendicular to the slot, FIGS. 9*a* to 9*e* show a method according to the invention for setting up the installation arrangement in FIG. 1.

The installation arrangement according to the invention which is illustrated in the drawings comprises a jack-up rig 1 and a barge 2. The jack-up rig 1 is designed to be self-floating and can also be self-driven. The jack-up rig 1 has a bow 3 and a stern section 4 which is slotted. The concept of a slot 6 should be understood here as an opening in the stern section 4 in a longitudinal direction L of the jack-up rig 1, which corresponds to the usual travel direction, wherein the slot 6 can have a width $B_S$ of for instance half a width $B_H$ of the jack-up rig 1 along the respective cross-section.

In the illustrated exemplary embodiment the slot 6 has a width $B_S$ of 32.2 m and a length $L_S$ of 100 m in the embodiment according to FIG. 1. The jack-up rig 1 itself can have a length $L_H$ of 160 m and a width $B_H$ of 60 m, but these are only examples of dimensions.

The slot 6 extends along the longitudinal direction L, preferably along the entire longitudinal extent of the barge 2 which is completely moved in, over the entire height $H_S$ of a hull 7. In particular, the hull 7 has no main loading deck in the region of the stern section 4 and of the slot 6. The slot 6 forms two lateral branches 7*a*, 7*b* in the hull 7, so that the stern section 4 of the jack-up rig 1 is therefore substantially U-shaped in a plan view, and the U-shaped branches 7*a*, 7*b* have a clear distance from one another over the entire longitudinal extent thereof and over the entire height thereof.

The jack-up rig 1 in FIG. 1 comprises four openings through which four supporting legs 9*a*, 9*b*, 9*c*, 9*d* are guided. Each of the supporting legs 9*a*, 9*b*, 9*c*, 9*d* is equipped with a lifting mechanism which makes it possible to lower the supporting legs 9*a*, 9*b*, 9*c*, 9*d* through the opening in the jack-up rig 1 as far as the seabed and, furthermore, to lift the hull 7 of the jack-up rig 1 out of the water along the supporting legs 9*a*, 9*b*, 9*c*, 9*d* which are arranged parallel to one another and stand vertically on the seabed, so that the hull 7 in a raised position no longer has any contact with the surface of the sea 17.

The jack-up rig 1 comprises a slewing crane 8 which is locked on the raised supporting legs 9*a*, 9*b*, 9*c*, 9*d* during transport of the jack-up rig 1 from the port to the location in order to enable secure and immobilised transport. The jack-up rig 1 can have a helicopter landing pad 11, a control bridge 12, etc. The bow 3 of the jack-up rig 1 is formed continuously in each cross-section along the width $B_H$. A deck on which components can also be transported is provided between both bow-side supporting legs 9*a*, 9*b*. In particular, according to FIG. 1 a barge 2 is moved into the slot 6. In a raised position the barge 2 rests in a positionally fixed manner, with lateral projections running in the longitudinal direction L, on brackets 13*a*, 13*b* arranged inside the U-shaped branches 7*a*, 7*b*. Thus the jack-up rig 1 is raised out of the sea together with the barge 2 during lifting of the installation arrangement.

FIG. 2 shows the jack-up rig 1 in FIG. 1 in a slightly more sideways view, so that the brackets 13*a*, 13*b* can be seen between the barge 2 and the slot 6. At the slot 6 the brackets 13*a*, 13*b* are arranged inside the inner walls of the branches 7*a*, 7*b* and extend almost over the entire longitudinal extent of the slot 7 along each of the two branches 7*a*, 7*b*.

The jack-up rig 1 is designed so that with the supporting legs 9*a*, 9*b*, 9*c*, 9*d* raised as in FIG. 2, with and also without the barge 2 moved into the slot 6, the jack-up rig floats autonomously on the surface of the sea and can also be brought to the location with self-propulsion by means of a drive (not shown). The securing means formed as brackets 13*a*, 13*b* on the slot side are arranged at such a height relative to the sea level and on the branch 7*a*, 7*b* that a barge 2 which is associated with the jack-up rig 1 and designed for the jack-up rig 1 and, in FIG. 2, is already moved into the slot 6, has lateral projections 16*a*, 16*b* at such a height H that the lateral projections 16*a*, 16*b* of the loaded barge 2 are arranged above the brackets 13*a*, 13*b*, i.e. viewed from the seabed they are arranged higher than the brackets 13, 13*b* of the jack-up rig, so that the barge with its lateral projections 16*a*, 16*b* can move over the brackets 13*a*, 13*b* into the slot 6 of the jack-up rig 1 or can be drawn into the slot. A bow-side section of an outer peripheral shape of the barge 2 corresponds in this connection to the inner peripheral shape of the slot 7, and the outer shape of the barge 2 is designed so that in a width $B_B$ and a length $L_B$ it is somewhat smaller than the clear width $B_S$ of the slot 7 and also than the clear length $L_S$ of the slot 7, so that it can be received completely in the slot 6 according to FIG. 2.

FIG. 3 shows the installation arrangement in a bow-side side view, and at the bow 3 the jack-up rig 1 has the control bridge 12 from which the jack-up rig 1 can be controlled. In FIG. 3 the slewing crane 8 is shown moved in.

FIG. 4 shows the jack-up rig of FIGS. 1 to 3 in a plan view. The slot 6 of the jack-up rig 1 extends in the longitudinal direction L over at least 50%, preferably at least 60%, particularly preferably at least 70% or 80% of the longitudinal extent of the jack-up rig 1. The slot 6 has, over almost its entire longitudinal extent, a constant width $B_S$ which constitutes approximately half the width $B_H$ of the jack-up rig. However, the width can also constitute at least 40% or at least 60% of the width $B_H$ of the jack-up rig 1 in the stern section 4. The brackets 13*a*, 13*b* run along the inner sides of the U-branches 17*a*, 17*b* of the slot 6. They have a length which corresponds approximately to half, preferably at least 60%, preferably at least 70%, preferably at least 80% of the length $L_S$ of the slot 6.

FIG. 5 shows the jack-up rig 1 in FIG. 2 without the slewing crane 8 in a stern-end view which shows the brackets 13*a*, 13*b* somewhat more clearly.

FIG. 6 shows the jack-up rig 1 in a plan view from a stern-end perspective, in which the two brackets 13*a*, 13*b* and the U-shaped design of the stern section 4 of the jack-up rig 1 can be seen.

FIG. 7 shows a plan view of the jack-up rig 1 in FIG. 2 with the barge 2 moved in. In principle the concept of the barge 2 wide should be construed in broad terms; it may be a vessel which is self-propelled or not self-propelled, preferably with a substantially level main loading deck, on which even very heavy components can be transported.

FIG. 8 shows a possible form of the embodiment of the securing means 13*a*, 13*b*, 7*a*, 7*b* in a basic formation in a sectional view. The two branches 7*a*, 7*b* in the stern section 4 of the jack-up rig 1 are arranged laterally. Each one of the brackets 13*a*, 13*b* is arranged at the seabed end of a respective one of the branches 7*a*, 7*b* which protrude into the clear distance between the branches 7*a*, 7*b* on the inside. The brackets 13*a*, 13*b* are intended to enable a barge 2 to rest with lateral projections 16*a*, 16*b* on the brackets 13*a*, 13*b* in the moved-in state, when the jack-up rig 1 is lifted out of the sea on its supporting legs 9*a*, 9*b*, 9*c*, 9*d*.

FIG. 8 shows the installation arrangement without the supporting legs 9*a*, 9*b*, 9*c*, 9*d* in a raised state of the jack-up rig 1 and of the barge 2 above the surface of the sea 17.

A method for setting up an installation arrangement according to FIGS. 1 to 8 is illustrated in FIGS. 9*a*, 9*b*, 9*c*, 9*d*, 9*e*. The installation arrangement comprises the jack-up rig 1 and the barge 2.

Figure 9A:
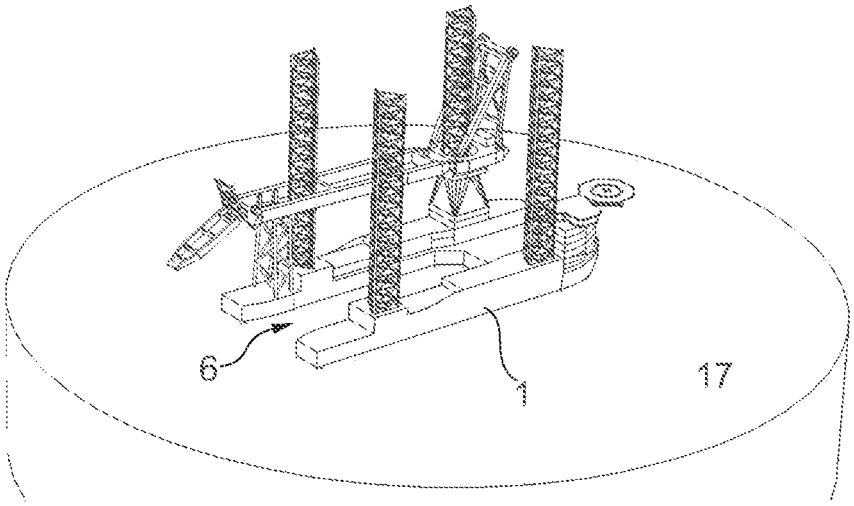

First of all the jack-up rig 1 is brought to the location according to FIG. 9*a*. The jack-up rig 1 can be self-propelled and can move to the location by itself without a further tug or the like.

Figure 9B:
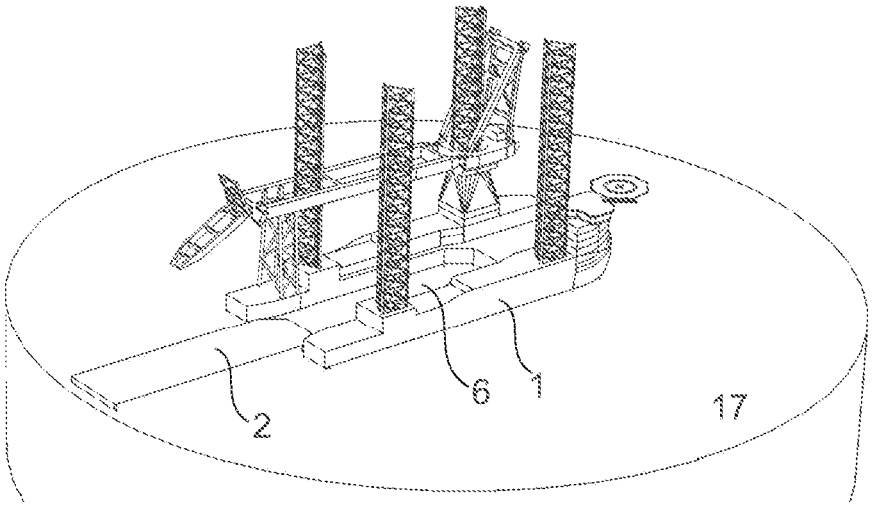
Figure 9C:
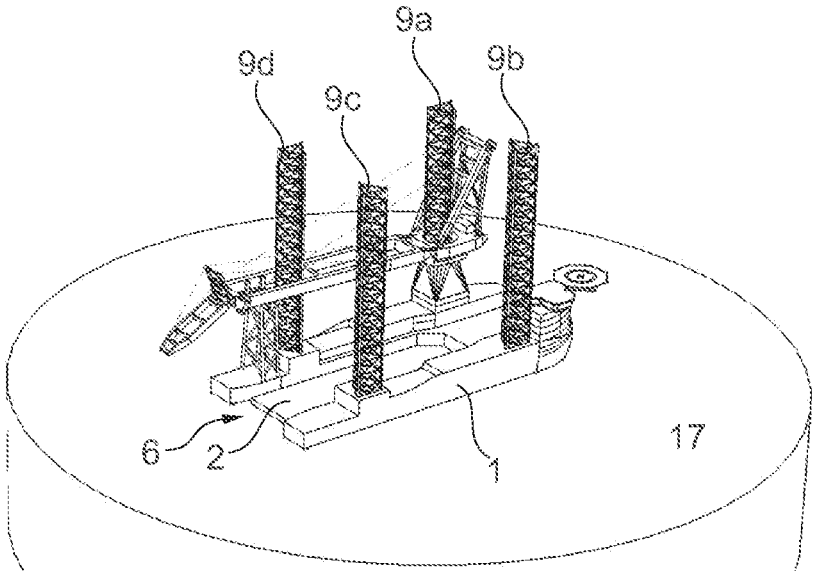

The barge 2 illustrated in FIG. 9*b* is usually laden with components which are intended for a technical plant to be constructed at the location, such as a wind turbine, a transformer platform or an oil platform or components thereof in each case. In FIG. 9*b*, however, the main loading deck of the barge 2 is empty. The barge 2 is moved vertically out of the stern end direction into the slot 6. In FIG. 9*b* the bow 3 of the barge 2 is already moved some way into the slot 6 of the jack-up rig 1. The slewing crane 8 is in the locked state.

In a third method step the barge 2 is already moved completely into the slot 6 of the jack-up rig 1 and (not shown in FIG. 9*c*) is arranged with its lateral projections 16*a*, 16*b* above the brackets 13*a*, 13*b* of the jack-up rig 1. If the barge 2 is so heavily laden that it lies too deep in the water and the lateral projections 16*a*, 16*b* are not arranged above the brackets 13*a*, 13*b* before they move into the slots 6, there is a possibility of ballasting. The jack-up rig 1 has compartments which can be flooded with sea water, so that the jack-up rig 1 is lowered in the sea relative to the surface of the sea 17. The jack-up rig 1 is lowered so far that the brackets 13*a*, 13*b* thereof are arranged below the lateral projections 16*a*, 16*b* of the barge 2, so that the barge 2 can be drawn into the slot 6. For this purpose ropes or other pulling mechanisms can be provided, which are not illustrated in the drawings.

Figure 9D:
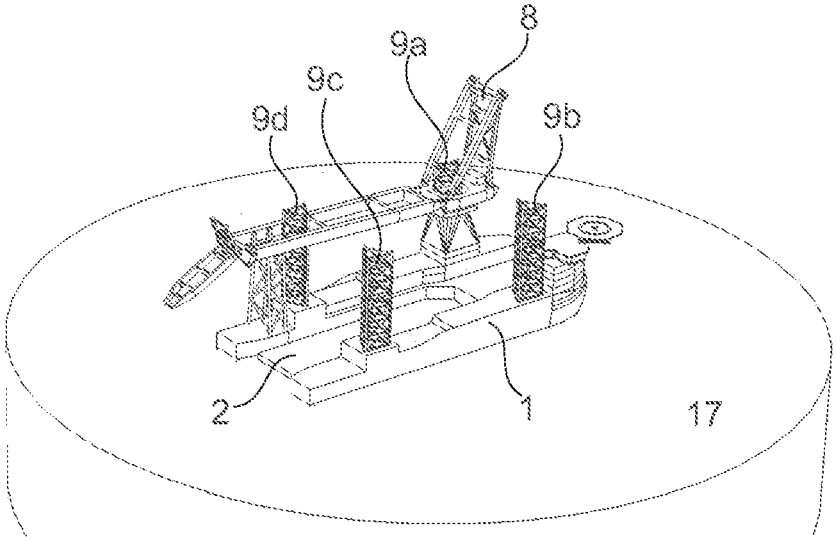

In FIG. 9*d* the supporting legs 9*a*, 9*b*, 9*c*, 9*d* are lowered onto the seabed, and each of the feet thereof is in contact with the seabed. The jack-up rig 1 is now lifted out of the sea by the lifting mechanism, a jacking system.

Figure 9E:
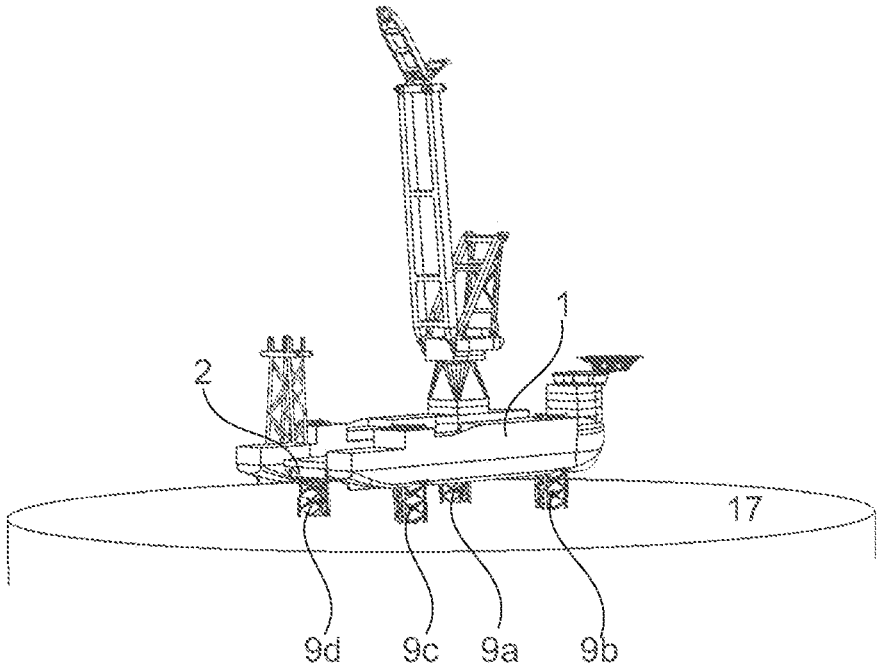

FIG. 9*e* shows the jack-up rig in the raised position. The four supporting legs 9*a*, 9*b*, 9*c*, 9*d* are in each case movable individually relative to the hull 7 of the jack-up rig 1. For this purpose a lifting mechanism in the form of a jacking system or the like is provided. First of all the supporting legs 9*a*, 9*b*, 9*c*, 9*d* are lowered onto the seabed, until each of the supporting legs 9*a*, 9*b*, 9*c*, 9*d* is in contact with the seabed. In principle, this lowering of the supporting legs 9*a*, 9*b*, 9*c*, 9*d* onto the seabed can also take place before the barge 2 is introduced into the slot 6.

After the supporting legs 9*a*, 9*b*, 9*c*, 9*d* have been lowered onto the seabed, the supporting legs 9*a*, 9*b*, 9*c*, 9*d* are arranged perpendicular to the seabed and parallel to one another. The lifting system enables makes it possible to lift the hull 7 of the jack-up rig 1 out of the sea together with the barge 2 resting on the brackets 13*a*, 13*b* so that, after the lifting, both the barge 2 and also the hull 7 of the jack-up rig 1 no longer have any contact with the surface of the sea 17. The raised state is illustrated in FIG. 9*d*.

LIST OF REFERENCE NUMERALS

1 jack-up rig
2 barge
3 bow
4 stern section
6 slot
7*a* branch
7*b* branch
8 slewing crane
9*a* supporting leg
9*b* supporting leg
9*c* supporting leg
9*d* supporting leg
11 helicopter landing pad
12 control bridge
13*a* bracket
13*b* bracket
16*a* lateral projection
16*b* lateral projection
17 surface of the sea
B width
$B_B$ width of the barge
$B_H$ width of the jack-up rig
$B_S$ width of the slot
H height
$H_S$ height of the slot
L longitudinal direction
$L_B$ length of the barge
$L_H$ length of the jack-up rig
$L_S$ length of the slot

The invention claimed is:

1. An installation arrangement with a barge (2) and a jack-up rig (1) which floats in a first position on the sea and has a hull (7) which is slotted vertically with respect to the surface (17) of the sea and has a slot width which is greater than a width (BB) of the barge (2) so that the barge (2) can move into a slot (6), wherein the jack-up rig (1) has supporting legs (9*a*, 9*b*, 9*c*, 9*d*) which can move up and down relative to the hull (7) along a height (H) of the hull (7) and can be set down on the seabed, and the hull (7) can be lifted, together with the barge (2) which has moved in, out of the water into a raised position by means of a lifting mechanism along the support legs (9*a*, 9*b*, 9*c*, 9*d*) which have been set down on the seabed, characterised in that the slot (6) extends along the entire longitudinal extent of the barge (2) which has moved in, over the entire height (H) of the hull (7), and that securing means (13*a*, 13*b*, 16*a*, 16*b*) are arranged on the barge (2) and on the slot (6) and said securing means (13*a*, 13*b*, 16*a*, 16*b*) interact and secure the barge (2) in the raised position in a fixed position on the jack-up rig (1).

2. The installation arrangement according to claim 1, characterised in that the slot (6) extends along at least 30% of its longitudinal extent over the entire height of the hull (7).

3. The installation arrangement according to claim 2, characterised in that the slot (6) extends along at least 50% of its longitudinal extent over the entire height of the hull (7).

4. The installation arrangement according to claim 3, characterised in that the slot (6) extends along at least 90% of its longitudinal extent over the entire height of the hull (7).

5. The installation arrangement according to claim 1, characterised in that at least one of the supporting legs (9*a*, 9*b*, 9*c*, 9*d*) is arranged on the bow side of the slot (6).

6. The installation arrangement according to claim 1, characterised in that a slewing crane (8) is arranged on the jack-up rig (1).

7. The installation arrangement according to claim 1, characterized in that lateral inner walls of the slot (6) which lie opposite one another each have at least one bracket on which the barge (2) rests in the raised position.

8. The installation arrangement according to claim 1, characterised in that the jack-up rig (1) has no main loading deck between the branches (7*a*, 7*b*) of the hull (7).

9. The installation arrangement according to claim 1, characterised in that the slot (6) separates the hull (7) along the slot (6) into two branches (7*a*, 7*b*) which are completely spaced apart from one another by a clear distance.

10. A method for setting up an installation arrangement with a barge (2) and a jack-up rig (1), by the jack- up rig (1) with a hull (7) slotted vertically to the surface (17) of the sea and a slot (6) with a slot width which is greater than a width ($B_B$) of the barge (2), wherein the slot (6) extends along the entire longitudinal extent of the barge (2) which has moved in, over the entire height (H) of the hull (7), being brought to the location by self-floating, supporting legs (9*a*, 9*b*, 9*c*, 9*d*) being lowered onto the seabed and setting down on the seabed, the barge (2) moving into the slot (6) of the jack-up rig (1) and securing means (13*a*, 13*b*, 16*a*, 16*b*) on the barge (2) and the slot (6) interacting, and the jack-up rig 1 being lifted out of the water with the barge (2).

11. The method according to claim 10, characterised in that as the barge (2) moves into the slot (6) it continuously has a clear distance from the seabed over the entire longitudinal extent of its underwater surface.

* * * * *